US005503688A

United States Patent [19]

Arnaud et al.

[11] Patent Number: 5,503,688

[45] Date of Patent: Apr. 2, 1996

[54] METAL WIRE COMPRISING A SUBSTRATE OF STEEL OF WORK-HARDENED TEMPERED MARTENSITE TYPE STRUCTURE AND A COATING

[75] Inventors: Jean-Claude Arnaud, Volvic; Bernard Prudence, Vic-Le-Comte; Raoul Serre, Ceyrat, all of France

[73] Assignee: Compagnie Generale Des Etab. Michelin Michelin & Cie, Cedex, France

[21] Appl. No.: 98,378

[22] PCT Filed: Feb. 12, 1992

[86] PCT No.: PCT/FR92/00134

§ 371 Date: Aug. 10, 1993

§ 102(e) Date: Aug. 10, 1993

[87] PCT Pub. No.: WO92/14811

PCT Pub. Date: Sep. 3, 1992

[30] Foreign Application Priority Data

Feb. 14, 1991 [FR] France ..... 91 01869

[51] Int. Cl.[6] ..... B60C 9/00; C21D 1/09

[52] U.S. Cl. ..... 148/534; 148/595; 152/451

[58] Field of Search ..... 148/532, 534, 148/599, 598, 595; 152/451

[56] References Cited

U.S. PATENT DOCUMENTS

| | | | |
|---|---|---|---|
| 4,106,957 | 8/1978 | Tournoy | 148/532 |
| 4,265,678 | 5/1981 | Hachisuka et al. | 148/532 |
| 5,338,380 | 8/1994 | Yutori et al. | 148/532 |

FOREIGN PATENT DOCUMENTS

| | | | |
|---|---|---|---|
| 0213917 | 11/1987 | European Pat. Off. . | |
| 0330752 | 6/1989 | European Pat. Off. . | |
| 0258249 | 7/1988 | Germany | 148/532 |
| 1770408 | 10/1992 | U.S.S.R. | 148/532 |

*Primary Examiner*—Scott Kastler

[57] ABSTRACT

A metal wire having a substrate and a coating. The substrate is a steel the carbon content of which is equal to at least 0.05% and at most 0.6%, this steel having a structure comprising more than 90% work-hardened tempered martensite. The substrate is coated with a metal alloy other than steel. Method of obtaining this wire. A steel machine wire comprising 28% to 96% proeutectoid ferrite and 72% to 4% pearlite is work hardened. A hardening treatment is carried out in order to obtain a structure comprising more than 90% martensite. A depositing of metals is then effected, the wire is heated to cause the formation of an alloy and the formation of a structure comprising more than 90% tempered martensite. The wire is cooled and work hardened. This wire is used, for instance, to reinforce tires.

21 Claims, 1 Drawing Sheet

METAL WIRE COMPRISING A SUBSTRATE OF STEEL OF WORK-HARDENED TEMPERED MARTENSITE TYPE STRUCTURE AND A COATING

The present invention relates to steel wires and methods of obtaining such wires. These wires are used, for instance, to reinforce plastic or rubber articles, in particular hoses, belts, plies and tires.

The wires of this type which are currently used at the present time are formed of steel containing at least 0.6% carbon, this steel having a work-hardened pearlitic structure. The rupture strength of these wires is about 2800 MPa (megapascals); their diameter generally varies from 0.15 to 0.35 mm and their elongation upon rupture is between 0.4% and 2%. These wires are produced by drawing from an initial wire known as "machine wire" the diameter of which is about 5 to 6 mm, the structure of this machine wire being a hard structure formed of pearlite and ferrite with a high proportion of pearlite, generally above 72%. Upon the production of this wire, the drawing operation is interrupted at least once in order to carry out one or more heat treatments which make it possible to regenerate the initial structure. After the last heat treatment, a deposit of alloy, for instance brass, on the wire is necessary in order for the final drawing operation to take place correctly.

This method has the following drawbacks:

The raw material is expensive, since the percentage of carbon is relatively high;

The parameters cannot be easily modified; in particular, the diameter of the machine wire and the final diameter are kept within rigid limits, the method therefore lacking flexibility;

The great hardness of the machine wire due to its highly pearlitic structure makes the drawing difficult before the heat treatment so that the deformation rate $\epsilon$ of this drawing is necessarily less than 3; furthermore, the speeds of this drawing are low and there may be breaks of the wire upon this operation;

The operation of the depositing of alloy, for example brass, is a step necessary for the process and it is not integrated in the heat-treatment step which precedes it.

Furthermore, the wires themselves have a rupture strength and ductility upon rupture which is at times insufficient, and they exhibit extensive damage as a result of the drawing prior to the heat treatment, due to the great hardness of the machine wire.

The purpose of the present invention is to provide a work-hardened steel wire which is coated with a metal alloy, the steel of this wire having a work-hardened non-pearlitic structure and having a rupture strength and elongation upon rupture at least as great as the known work-hardened pearlitic steel wires and less damage from the drawing than the known wires.

Another object of the invention is to propose a method for the production of this wire which does not have the drawbacks indicated above.

The metal wire of the invention, which comprises a substrate and a coating, has the following characteristics:

a) it comprises a substrate of steel having a carbon content equal to at least 0.05% and at most 0.6%;

b) this steel has a structure comprising more than 90% work-hardened tempered martensite;

c) the substrate is coated with a metal alloy other than steel;

d) the diameter of the wire is equal to at least 0.10 mm and at most 0.40 mm;

e) the rupture strength of the wire is equal to at least 2800 MPa;

f) the elongation upon rupture of the wire is equal to at least 0.4%.

The method of the invention for the production of this coated steel wire is characterized by the following points:

a) a machine wire of steel is work hardened, said steel having a carbon content equal to at least 0.05% and to at most 0.6%, said steel comprising 28% to 96% proeutectoid ferrite and 72% to 4% pearlite; the deformation rate $\epsilon$ of this work hardening being at least 3;

b) the work hardening is stopped and a hardening heat treatment is carried out on the work-hardened wire, this treatment consisting of heating the wire to above the AC3 transformation point in order to impart to it a homogeneous austenite structure, whereupon it is recooled rapidly to below the martensite transformation finish point $M_F$, the rate of this cooling being equal to at least 150° C./second, so as to obtain a structure comprising more than 90% martensite;

c) at least two metals capable of forming an alloy by diffusion are then deposited on the wire, the steel thus serving as substrate;

d) the wire is then heated to a temperature equal to at least 0.3 $T_F$ and at most 0.5 $T_F$ so as to cause the formation by diffusion of an alloy of these deposited metals, as well as the formation, for the steel, of a structure comprising more than 90% tempered martensite, $T_F$ being the melting point of the steel, expressed in Kelvin;

e) the wire is then cooled to a temperature below 0.3 $T_F$;

f) a work hardening is then carried out on the wire, the temperature of the wire upon this work hardening being less than 0.3 $T_F$, the deformation rate $\epsilon$ of this work hardening being equal to at least 1.

The invention also concerns the assemblages comprising at least one wire in accordance with the invention.

The invention also concerns articles reinforced at least in part by wires or assemblages in accordance with the above definitions, such articles being, for instance, hoses, belts, plies and tires.

The invention will be easily understood by means of the following embodiments and the diagrammatic figures relating to these embodiments.

Figure 1:
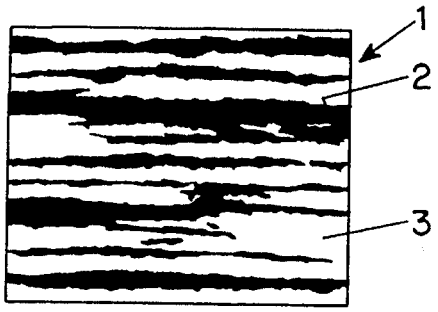
FIG. 1 shows the structure of the steel of a wire prior to the heat treatments, upon the carrying out of the method in accordance with the invention.

In the following, all the percentages indicated are by weight and the measurements of rupture strength and elongation upon rupture are carried out in accordance with AFNOR Method NFA 03-151.

By definition, the deformation rate $\epsilon$ of a work hardening is given by the formula $\epsilon = \ln(So/Sf)$, ln being the natural logarithm, So being the initial cross section of the wire before said work hardening and Sf being the cross section of the wire after said work hardening.

The purpose of the following examples is to describe the preparation and the properties of three wires in accordance with the invention.

In these examples, a non-work-hardened machine wire of 5.5 mm diameter is used. This machine wire is formed of a steel the characteristics of which are as follows:

carbon content: 0.4% manganese content: 0.5% silicon content: 0.2% phosphorus content: 0.015% sulfur content: 0.02% aluminum content: 0.015% nitrogen content: 0.005% chromium content: 0.05% nickel content: 0.10% copper content: 0.10% molybdenum content: 0.01% proeutectoid ferrite content: 53% pearlite content: 47% melting point of the steel, $T_F$:1795 K martensite transformation finish point $M_F$: 150° C.

rupture strength $R_m$: 700 MPa elongation upon rupture $A_r$: 17%

Three wires in accordance with the invention are produced with this machine wire in the following manner:

EXAMPLE 1

The machine wire is descaled, coated with a drawing soap, for instance borax, and drawn dry to obtain a wire of a diameter of 1.1 mm which corresponds to a deformation rate $\epsilon$ slightly greater than 3.2.

The drawing is effected easily due to the relatively ductile structure of the machine wire. By way of example, a non-work-hardened steel containing 0.7% carbon has a rupture strength $R_m$ of about 900 MPa and an elongation upon rupture $A_r$ of about 8%; in other words, it is clearly less ductile.

By way of example, this drawing is effected at a temperature below 0.3 $T_F$ for purposes of simplification, although this is not indispensable, as the drawing temperature may possibly equal or exceed 0.3 $T_F$.

FIG. 1 is a section through a portion 1 of the structure of the wire thus obtained. This structure is formed of elongated blocks 2 of cementite and of elongated blocks 3 of ferrite, the largest dimension of these blocks being oriented in the direction of drawing.

The following heat treatments are then carried out on the wire which has thus been obtained:

the wire is heated by convection in a muffle furnace in order to bring it to 950° C., that is to say to above the AC3 transformation point, and it is held at this temperature for 30 seconds so as to obtain a homogeneous austenite structure;

the wire is then cooled in a gaseous ring produced by a turbine to a temperature of 75° C., that is to say below the martensite transformation finish point $M_F$ in less than 3.5 seconds, so as to obtain a structure comprising more than 90% martensite in laths.

Figure 2:
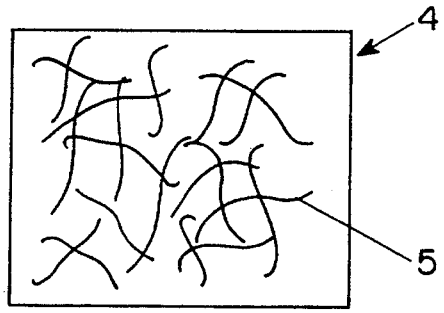
FIG. 2 shows the structure of the steel of a wire after the hardening heat treatment, upon the carrying out of the method in accordance with the invention.

FIG. 2 shows a section through a portion 4 of the structure thus obtained, the martensite laths being represented by the reference numeral 5.

The wire is then degreased. It is then copper-plated and then covered with zinc electrolytically at room temperature. It is then heat-treated by Joule effect at 540° C. (813 K.) for 2.5 seconds, and then cooled to room temperature (about 20° C., namely 293 K.).

This last treatment makes it possible to obtain brass by diffusion of the copper and zinc and also, with respect to the steel, a structure comprising more than 90% tempered martensite. The thickness of this layer of brass is slight (on the order of a micrometer) and it is negligible as compared with the diameter of the wire.

Figure 3:
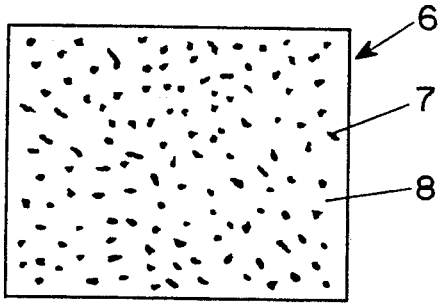
FIG. 3 shows the structure of the steel of a brass-coated wire upon the carrying out of the method in accordance with the invention.

FIG. 3 shows a section through a portion 6 of the structure of the wire thus obtained. This structure comprises precipitates of carbides 7 distributed substantially homogeneously through a matrix 8 of ferritic type. This structure is obtained by the previous heat treatments and it is retained upon cooling to room temperature. The precipitates 7 have, in general, dimensions equal to at least 0.005 μm (micrometer) and to at most 1 μm.

A wet drawing of this wire is then effected so as to obtain a final diameter of 0.2 mm, which corresponds substantially to $\epsilon$=3.4. The temperature of the wire upon this drawing is necessarily less than 0.3 $T_F$. The thickness of the brass of the wire thus drawn is very slight, on the order of a tenth of a micrometer.

Figure 4:
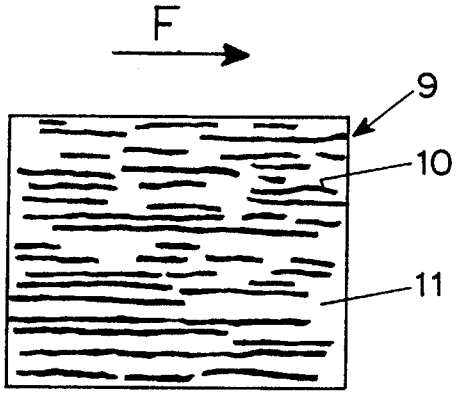
FIG. 4 shows the structure of the steel of a wire in accordance in the invention.

FIG. 4 shows a longitudinal section through the portion 9 of the steel of this wire according to the invention which is thus obtained. This portion 9 has a structure of work-hardened tempered martensite type formed of carbides 10 of elongated shape which are substantially parallel to each other and the largest dimension of which is oriented along the axis of the wire, that is to say along the direction of drawing indicated schematically by the arrow F in FIG. 4. These carbides 10 are disposed in a work-hardened matrix 11.

This wire in accordance with the invention has a rupture strength of 3000 MPa and an elongation upon rupture of 0.7%.

EXAMPLE 2

The machine wire is scaled, coated with a layer of drawing soap, for instance borax, and drawn dry so as to obtain a wire of a diameter of 0.9 mm, which corresponds to a deformation rate $\epsilon$ slightly greater than 3.6. The structure obtained is similar to that shown in FIG. 1. The following heat treatments are then carried out on the wire thus obtained:

The wire is heated by Joule effect to bring it to 1000° C. for 3 seconds, that is to say, above the AC3 transformation point, so as to obtain a homogeneous austenite structure. The wire is then cooled in an oil bath to a temperature of 100° C., that is to say below the transformation finish point $M_F$ in less than 3 seconds so as to obtain a structure comprising more than 90% martensite in laths, the structure of the wire obtained being in accordance with FIG. 2.

The wire is then degreased. It is then copper-plated and then covered with zinc electrolytically at room temperature. It is then heat-treated by Joule effect at 540° C. (813 K.) for 2.5 seconds and then cooled to room temperature, these treatments being identical to Example 1.

The structure obtained for this wire which is thus coated with brass in this manner is similar to that shown in FIG. 3. The wire is then drawn wet so as to obtain a final diameter of 0.17 mm, which corresponds substantially to $\epsilon$=3.3. The temperature of the wire upon this drawing is less than 0.3 $T_F$. The steel of the wire according to the invention thus obtained thus has a structure similar to that shown in FIG. 4.

This wire has a rupture strength equal to 2850 MPa and an elongation upon rupture equal to 1%.

EXAMPLE 3

A wire of a diameter of 1.1 mm, obtained in the same manner as in Example 1 by drawing the machine wire, is heated by Joule effect at 1000° C. for 3 seconds, that is to say above the AC3 transformation point, so as to obtain a homogeneous austenite structure.

The wire is then cooled, in a gaseous ring produced by a turbine, to a temperature of 100° C., that is to say below the transformation finish point $M_F$, in less than 3 seconds, so as to obtain a structure comprising more than 90% martensite in laths.

The wire is then coppered and then coated with zinc electrolytically at room temperature and then heat treated by Joule effect at 500° C. (773 K.) for 5 seconds. It is then cooled to room temperature; the wire which is thus brass-coated is then drawn wet at a temperature below 0.3 $T_F$ to a diameter of 0.17 mm, which corresponds substantially to $\epsilon$=3.7. This wire, in accordance with the invention, has a rupture strength of 3200 MPa and an elongation upon rupture of 0.6%.

The intermediate structures and the final structure are similar to the structures previously described.

The invention has the following advantages:

one starts from a machine wire of low carbon content and therefore of low cost;

there is great flexibility in the selection of the diameters of the wires; thus, for instance, one can use machine wires of a diameter substantially greater than 6 mm, which further reduces the cost, and one can produce wires of very different diameter;

the drawing before the heat treatments is relatively easy so that the deformation rate $\epsilon$ of this drawing can be greater than 3; furthermore, this drawing can be carried out with high speeds; finally, the frequency of wire breaks and of changes of dies is reduced, which further reduces the cost;

the diffusion treatment for obtaining the alloy is effected at the same time as the tempering of the wire, which avoids an additional diffusion operation and therefore limits the cost of manufacture while permitting an overall online treatment of the wire, from the machine wire up to the final wire;

the wire obtained has a rupture strength and an elongation upon rupture equal to at least those of conventional wires, which therefore means a rupture energy which is equal to at least that of the conventional wires;

the wire is less damaged upon the drawing before heat treatment;

the wire obtained has better resistance to corrosion than the conventional wires as a result of its low content of carbon.

Upon the hardening treatment effected from the homogeneous austenite from a temperature above the AC3 transformation point to a temperature less than $M_F$, since the rate of cooling is equal to at least 150° C. in accordance with the invention, less than 10% of the homogeneous austenite is transformed before reaching the temperature corresponding to the martensite transformation starting point ($M_S$) so that, at the end of this hardening the structure contains more than 90% martensite, this structure possibly being formed completely of martensite. The martensite obtained after the hardening preferably has a lath structure, as described in the examples.

The steel of the wire in accordance with the invention, and therefore the initial machine wire, preferably has a carbon content equal to at least 0.2% and at most 0.5%.

In the steel of the wire according to the invention, and therefore in the initial machine wire, the composition preferably is as follows: 0.3%≦Mn≦0.6%; 0.1%≦Si≦0.3; P≦0.02%; S≦0.02%; Al≦0.02%; N≦0.006%.

In the steel of the wire in accordance with the invention, and therefore in the initial machine wire, the composition is advantageously as follows: Cr≦0.06%; Ni≦0.15%; Cu≦0.15%.

In the method according to the invention, one has preferably at least one of the following characteristics:

the initial machine wire has a proeutectoid ferrite content equal to at least 41% and at most 78%, and a pearlite content equal to at least 22% and to at most 59%;

the deformation rate $\epsilon$ upon the work hardening before the heat treatments is equal to at least 3.2 and to at most 6;

the deformation rate $\epsilon$ upon the final work hardening after the heat treatments is equal to at least 3 and to at most 5;

the hardening heat treatment is carried out with a speed of cooling equal to at least 250° C./second.

The work hardening of the wire in the above examples is effected by drawing, but other techniques are possible, for instance rolling, associated possibly with drawing, for at least one of the work-hardening operations. Of course, the invention is not limited to the embodiments described above; thus for instance, the invention applies to cases in which an alloy other than brass is produced, with two metals or more than two metals, for instance the ternary alloys copper-zinc-nickel, copper-zinc-cobalt, copper-zinc-tin, the essential thing being that the metals used are capable of forming an alloy by diffusion at a temperature equal to at least 0.3 $T_F$ and at most 0.5 $T_F$.

We claim:

1. A metal wire comprising a substrate and a coating, said wire having the following characteristics:

a) it comprises a substrate of steel having a carbon content of at least 0.05% and at most 0.6%;

b) this steel has a structure comprising more than 90% work-hardened tempered martensite;

c) the substrate is coated with a metal alloy other than steel;

d) the diameter of the wire is equal to at least 0.10 mm and at most 0.40 mm;

e) the rupture strength of the wire is equal to at least 2800 MPa;

f) the elongation upon rupture of the wire is equal to at least 0.4%.

2. A method of obtaining a metal wire having the following characteristics:

1) it comprises a substrate of steel having a carbon content of at least 0.05% and at most 0.60%;

2) this steel has a structure comprising more than 90% work-hardened tempered martensite;

3) the substrate is coated with a metal alloy other than steel;

4) the diameter of the wire is equal to at least 0.10 mm and at most 0.40 mm;

5) the rupture strength of the wire is equal to at least 2800 MPa;

6) the elongation upon rupture of the wire is equal to at least 0.40%;

wherein the method comprises the steps of:

a. work hardening a machine wire of steel, said steel having a carbon content of 0.05% to 0.6%, and comprising 28% to 96% proeutectoid ferrite and 72% to 4% pearlite; the deformation rate $\epsilon$ of the work hardening being equal to at least 3;

b. stopping the work hardening and carrying out a heat hardening treatment on the work-hardened wire, said treatment comprising heating the wire above the AC3 transformation point in order to impart to it a homogeneous austenite structure and then cooling it rapidly below the martensite transformation finish point $M_F$, the rate of this cooling being at least 150° C./second, so as to obtain a structure comprising more than 90% martensite;

c. depositing on the wire at least two metals capable of forming an alloy by diffusion, the steel thus serving as substrate;

d. heating the wire to a temperature of at least 0.3 $T_F$ and to at most 0.5 $T_F$, so as to cause the formation by diffusion of an alloy of the deposited metals, as well as the formation, in the case of the steel, of a structure comprising more than 90% tempered martensite, $T_F$ being the melting point of the steel, expressed in Kelvin;

e. cooling the wire to a temperature of less than 0.3 $T_F$; and f. effecting a work hardening on the wire, the temperature of the wire subjected to the work hardening being less than 0.3 $T_F$, the deformation rate $\epsilon$ of the work hardening being equal to at least 1.

3. A method according to claim 2, wherein the initial machine wire has a carbon content equal to at least 0.2% and to at most 0.5%.

4. A method according to claim 2, wherein the machine wire satisfies the following relationships: $0.3\% \leqq Mn \leqq 0.6$; $0.1\% \leqq Si \leqq 0.3\%$; $P \leqq 0.02\%$; $S \leqq 0.02$; $Al \leqq 0.02\%$; $N \leqq 0.006\%$.

5. A method according to claim 4, wherein the machine wire satisfies the following relationships: $Cr \leqq 0.06\%$; $Ni \leqq 0.15\%$; $0.15\%\ Cu < 0.15\%$.

6. A method according to claim 2, wherein the fact that the initial machine wire has a proeutectoid ferrite content equal to at least 41% and to at most 78% and a pearlite content equal to at least 22% and at most 59%.

7. A method according to claim 2, wherein the deformation rate $\epsilon$ upon the work hardening prior to the heat treatments is equal to at least 3.2 and to at most 6.

8. A method according to claim 2, wherein the deformation rate $\epsilon$ upon the final work hardening after the heat treatments is equal to at least 3 and to at most 5.

9. A method according to claim 2, wherein the deposit effected on the wire after the hardening heat treatment is a deposit of copper and zinc.

10. A method according to claim 2, wherein at least one work hardening is carried out at least in part by drawing.

11. A method according to claim 2, wherein the hardening heat treatment is carried out with a rate of cooling equal to at least 250° C./second.

12. A method according to claim 11, wherein the hardening heat treatment imparts to the wire a structure comprising more than 90% martensite in laths.

13. An assemblage comprising at least one wire having the following characteristics:

1) it comprises a substrate of steel having a carbon content of at least 0.05% and at most 0.60%;

2) this steel has a structure comprising more than 90% work-hardened tempered martensite;

3) the substrate is coated with a metal alloy other than steel;

4) the diameter of the wire is equal to at least 0.10 mm and at most 0.40 mm;

5) the rupture strength of the wire is equal to at least 2800 MPa;

6) the elongation upon rupture of the wire is equal to at least 0.40%.

14. An article reinforced with at least one wire having the following characteristics:

1) it comprises a substrate of steel having a carbon content of at least 0.05% and at most 0.60%;

2) this steel has a structure comprising more than 90% work-hardened tempered martensite;

3) the substrate is coated with a metal alloy other than steel;

4) the diameter of the wire is equal to at least 0.10 mm and at most 0.40 mm;

5) the rupture strength of the wire is equal to at least 2800 MPa;

6) the elongation upon rupture of the wire is equal to at least 0.40%.

15. An article reinforced with at least one assemblage wherein the assemblage comprises a wire having the following characteristics:

1) it comprises a substrate of steel having a carbon content of at least 0.05% and at most 0.60%;

2) this steel has a structure comprising more than 90% work-hardened tempered martensite;

3) the substrate is coated with a metal alloy other than steel;

4) the diameter of the wire is equal to at least 0.10 mm and at most 0.40 mm;

5) the rupture strength of the wire is equal to at least 2800 MPa;

6) the elongation upon rupture of the wire is equal to at least 0.40%.

16. An article according to claim 14, wherein the article is a tire.

17. An article according to claim 15, wherein the article is a tire.

18. A metal wire having the following characteristics:

1.) it comprises a substrate of steel having a carbon content of at least 0.2% and at most 0.5%;

2.) this steel has a structure comprising more than 90% work-hardened tempered martensite;

3.) the substrate is coated with a metal alloy other than steel;

4.) the diameter of the wire is equal to at least 0.10 mm and at most 0.40 mm;

5.) the rupture strength of the wire is equal to at least 2800 MPa;

6.) the elongation upon rupture of the wire is equal to at least 0.40%.

19. A metal wire having the following characteristics:

1) it comprises a substrate of steel having a carbon content of at least 0.05% and at most 0.60%;

2) this steel has a structure comprising more than 90% work-hardened tempered martensite;

3) the substrate is coated with a metal alloy other than steel;

4) the diameter of the wire is equal to at least 0.10 mm and at most 0.40 mm;

5) the rupture strength of the wire is equal to at least 2800 MPa;

6) the elongation upon rupture of the wire is equal to at least 0.40%, wherein the steel satisfies the following relationships: 0.3%≦Mn≦0.6%; 0.1%≦Si≦0.3%; P≦0.02%; S≦0.02%; Al≦0.02%; N≦0.006%.

20. A metal wire having the following characteristics:

1) it comprises a substrate of steel having a carbon content of at least 0.05% and at most 0.60%;

2) this steel has a structure comprising more than 90% work-hardened tempered martensite;

3) the substrate is coated with a metal alloy other than steel;

4) the diameter of the wire is equal to at least 0.10 mm and at most 0.40 mm;

5) the rupture strength of the wire is equal to at least 2800 MPa;

6) the elongation upon rupture of the wire is equal to at least 0.40%, wherein the steel satisfies the following relationships: 0.3%≦Mn≦0.6%; 0.1%≦Si≦0.3%; P≦0.02%; S≦0.02%; Al ≦0.02%; N≦0.006%; Cr≦0.06%; Ni≦0.15%; Cu≦0.15%.

21. A metal wire having the following characteristics:

1) it comprises a substrate of steel having a carbon content of at least 0.05% and at most 0.60%;

2) this steel has a structure comprising more than 90% work-hardened tempered martensite;

3) the substrate is coated with a metal alloy other than steel;

4) the diameter of the wire is equal to at least 0.10 mm and at most 0.40 mm;

5) the rupture strength of the wire is equal to at least 2800 MPa;

6) the elongation upon rupture of the wire is equal to at least 0.40%, wherein the metal alloy is brass.

* * * * *

UNITED STATES PATENT AND TRADEMARK OFFICE

CERTIFICATE OF CORRECTION

PATENT NO. : 5,503,688

DATED : Apr. 2, 1996

INVENTOR(S) : Arnaud et al.

It is certified that error appears in the above-indentified patent and that said Letters Patent is hereby corrected as shown below:

Col. 7, line 43, "wherein the fact that" should read --wherein--.

Signed and Sealed this

Ninth Day of July, 1996

*Attest:*

*Attesting Officer*

BRUCE LEHMAN

*Commissioner of Patents and Trademarks*